United States Patent [19]

Billman et al.

[11] Patent Number: 4,990,097

[45] Date of Patent: Feb. 5, 1991

[54] ELECTRICAL CONNECTOR WITH MODULE EXTRACTION APPARATUS

[75] Inventors: Timothy B. Billman, King; Roger L. Thrush, Clemmons, both of N.C.

[73] Assignee: AMP Incorporated, Harrisburg, Pa.

[21] Appl. No.: 483,193

[22] Filed: Feb. 21, 1990

[51] Int. Cl.[5] ..... H01R 13/62

[52] U.S. Cl. ..... 439/160; 439/636

[58] Field of Search ..... 439/152–160, 439/325–328, 629–637, 64

[56] References Cited

U.S. PATENT DOCUMENTS

| | | | |
|---|---|---|---|
| 3,150,906 | 9/1964 | Chambon et al. | 439/157 |
| 4,477,138 | 10/1988 | Andrews, Jr. et al. | 339/65 |
| 4,537,454 | 8/1985 | Douty et al. | 339/45 M |
| 4,548,456 | 10/1985 | Robertson | 439/631 |
| 4,557,548 | 12/1985 | Thrush | 339/258 P |
| 4,558,912 | 12/1985 | Coller et al. | 339/64 M |
| 4,698,024 | 10/1987 | Maxwell | 439/160 |
| 4,722,700 | 2/1988 | Kuhn et al. | 439/629 |
| 4,725,250 | 2/1988 | Kuhn et al. | 439/629 |
| 4,778,395 | 10/1988 | Narita | 439/159 |
| 4,781,612 | 11/1988 | Thrush | 439/328 |
| 4,898,540 | 2/1990 | Saito | 439/153 |
| 4,952,161 | 8/1990 | Komatsu | 439/159 |

OTHER PUBLICATIONS

U.S. Patent Application Ser. No. 360,644, filed 6-2-89.

U.S. Pat. No. 4,898,540 Abstract contained in Feb. 6, 1990 Official Gazette.

*Primary Examiner*—David L. Pirlot

*Attorney, Agent, or Firm*—Robert W. Pitts; Allan B. Osborne

[57] ABSTRACT

A socket suitable for use with single in-line memory modules comprises a plurality of terminals positioned within a insulative housing for engaging a module circuit panel inserted into the housing. Extraction members are provided for pivoting the individual circuit panels out of engagement with the socket terminals and out of the slot into which the circuit panel can be inserted. The extraction members are insertable into upright support members on the ends of the housing and are shiftable in a straight line motion between the first and second position. A projection at the lower edge of the extraction member extends below the circuit panel and a handle at the upper end of the extraction member is accessible on the end of the socket housing.

6 Claims, 5 Drawing Sheets

40
42
50
40'
42'
26
34
32
30
28
20
46
62
54
48
50
34'
32'
58
60
38
2
14
18
10
12
16

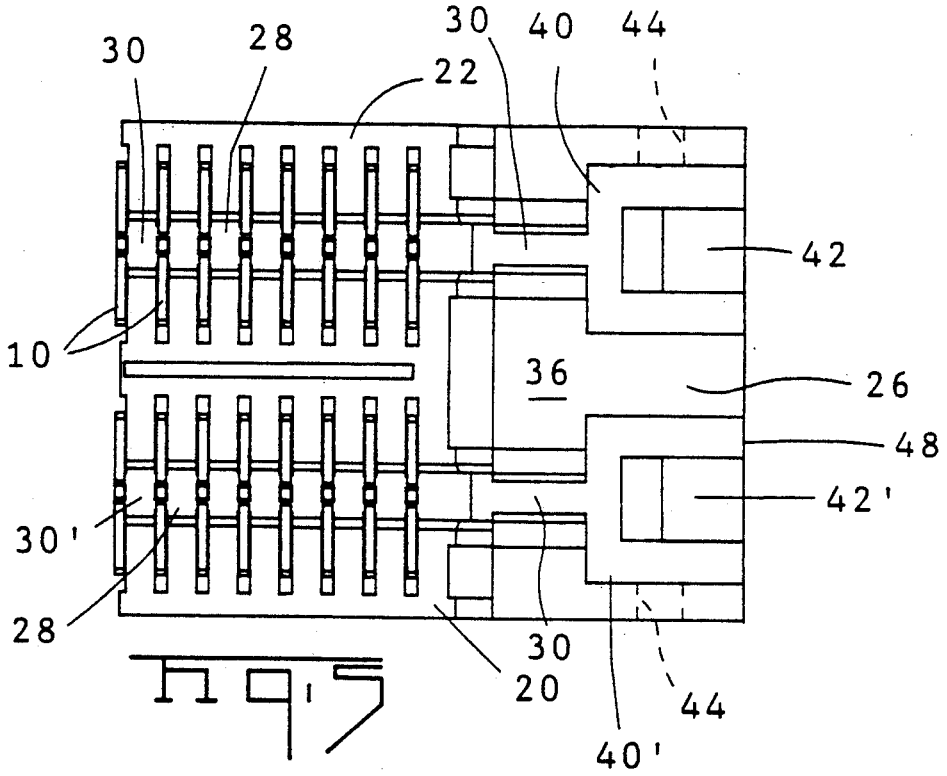
Fig. 5
Fig. 6
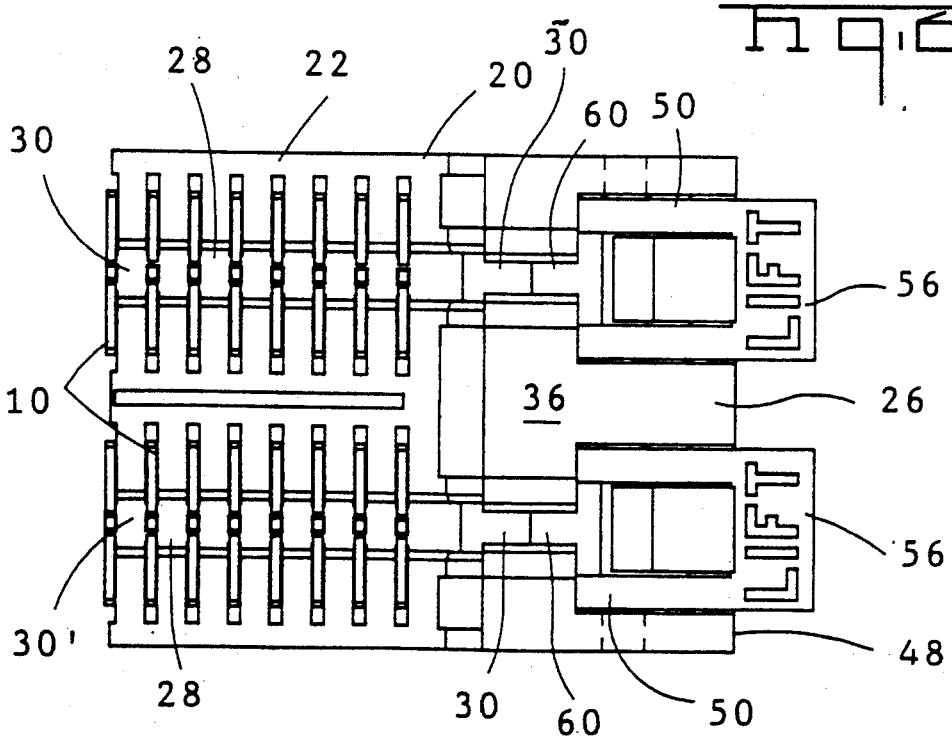

ELECTRICAL CONNECTOR WITH MODULE EXTRACTION APPARATUS

BACKGROUND OF THE INVENTION

1. Field of the Invention

This application relates to an electrical connector of the type suitable for use in establishing an interconnector to traces on a circuit panel, especially to an electrical connector socket for use in establishing electrical interconnections to a single in-line memory module, and more particularly to a socket having a member for extracting the module.

2. Description of the Prior Art

Single in-line memory modules constitute a high density, low profile single in-line package for electronic components such as dynamic random access memory integrated circuit components. A plurality of these components can be mounted in line on a circuit panel whose height is little more than the length of the components themselves. The circuit panels can in turn be mounted on a printed circuit board daughtercard which can then be mounted on a printed circuit board mothercard. The spacing between adjacent daughtercards would then need to be only slightly greater than the height of the individual circuit panels or single in-line memory modules.

One approach for mounting single in-line memory modules on a daughterboard would be to employ plug in leads adjacent one edge of the circuit panel. These plug in leads can then be connected to conventional printed circuit board contacts such as miniature spring contacts.

An alternate approach has been to use single in-line memory module sockets to establish a disconnectable interconnection to traces along the edge of the circuit panel used in the single in-line memory module. Terminals for use in such sockets are disclosed in U.S. Pat. No. 4,557,548 and U.S. Pat. No. 4,558,912. Additional details of an insulative housing which is suitable for use with those terminals is disclosed in U.S. Pat. 4,781,612. The socket disclosed in these patents is intended for use with in-line memory modules having a center line spacing for pads or traces at the edge of the circuit panel of 0.100 inch. Since the terminals employed in that socket are stamped and formed, the width of the terminals generally precludes establishing an interconnection on closer center line spacings.

U.S. Pat. No. 4,725,250 discloses a socket connector employing a terminal in which a full force wiping action is established between the terminals and the surface pad portions of traces on the circuit panel. This connector also includes edged stamped terminals.

The connector shown in U.S. Pat. No. 4,725,250 is suitable for use with standard single in-line memory modules. However, not all commercially available single in-line memory modules are manufactured in compliance with generally accepted standards for such modules, such as appropriate JEDEC standards. Nonstandard single in-line memory module circuit panels are manufactured with the pad portions of the traces adjacent the edge of the circuit panel being shorter than required by industry acknowledged standards. The connector disclosed in U.S. Pat. No. 4,725,250 is unsuitable for use with circuit panels having short pad portions where contact must be established immediately adjacent the edge of the circuit panel because of the height of the beams used to establish the full force wipe contact in that connector. U.S. Pat. Application Ser. No. 360,644 filed June 2, 1989, and incorporated herein by reference, discloses an electrical connector for establishing a full force interconnection with nonconforming single in-line memory modules. The instant invention is a modification of the socket disclosed in that application. The instant invention incorporates an extraction tool in the housing which permits the removal of a single in-line memory module from the socket and permits disengagement of the traces on the single in-line memory module circuit panel from terminals in the socket.

SUMMARY OF THE INVENTION

This electrical connector or socket has a plurality of terminals positioned within an insulative housing for engaging a circuit panel, such as a circuit panel used in a single in-line memory module. The circuit panel is held in the insulative housing with the terminals in engagement with traces on the circuit panel. An extraction apparatus is shiftable within the housing between the first and the second position to release the circuit panel from engagement with the terminals in the socket. This extraction apparatus also moves the single in-line memory module to permit its complete removal from the socket. The extraction apparatus includes a projection located below the point at which the circuit panel is gripped for retention in the housing, and the projection also extends below the circuit panel. A handle on the extraction apparatus extends beyond the housing to permit actuation of the extraction apparatus and movement from the first to the second position. In the preferred embodiment of this invention two parallel arms extend from opposite sides of a handle and a projection extends laterally of the arm in the extraction member. A protruding member on one arm of the extraction member extends into a groove on the housing. The protruding member extending into the groove both prevents removal of the extraction member from the housing and causes the extraction member to be moveable only in a straight line. The electrical connector or socket comprising the preferred embodiment of the invention is especially adapted to be mounted on a substrate to receive a circuit panel and to position the circuit panel in transverse relationship relative to the substrate and at the same time to electrically interconnect circuits on the substrate to corresponding circuits on the circuit panel.

BRIEF DESCRIPTION OF THE DRAWINGS

FIG. 3 is a perspective view of the extraction member.

FIG. 5 is a view of a portion of the top of the socket showing the pockets in which the extraction member is inserted.

FIG. 6 is a view similar to FIG. 5 showing two extraction members fitted within side-by-side pockets in a socket suitable for handling two circuit panels.

DETAILED DESCRIPTION OF THE PREFERRED EMBODIMENT

Figure 1:
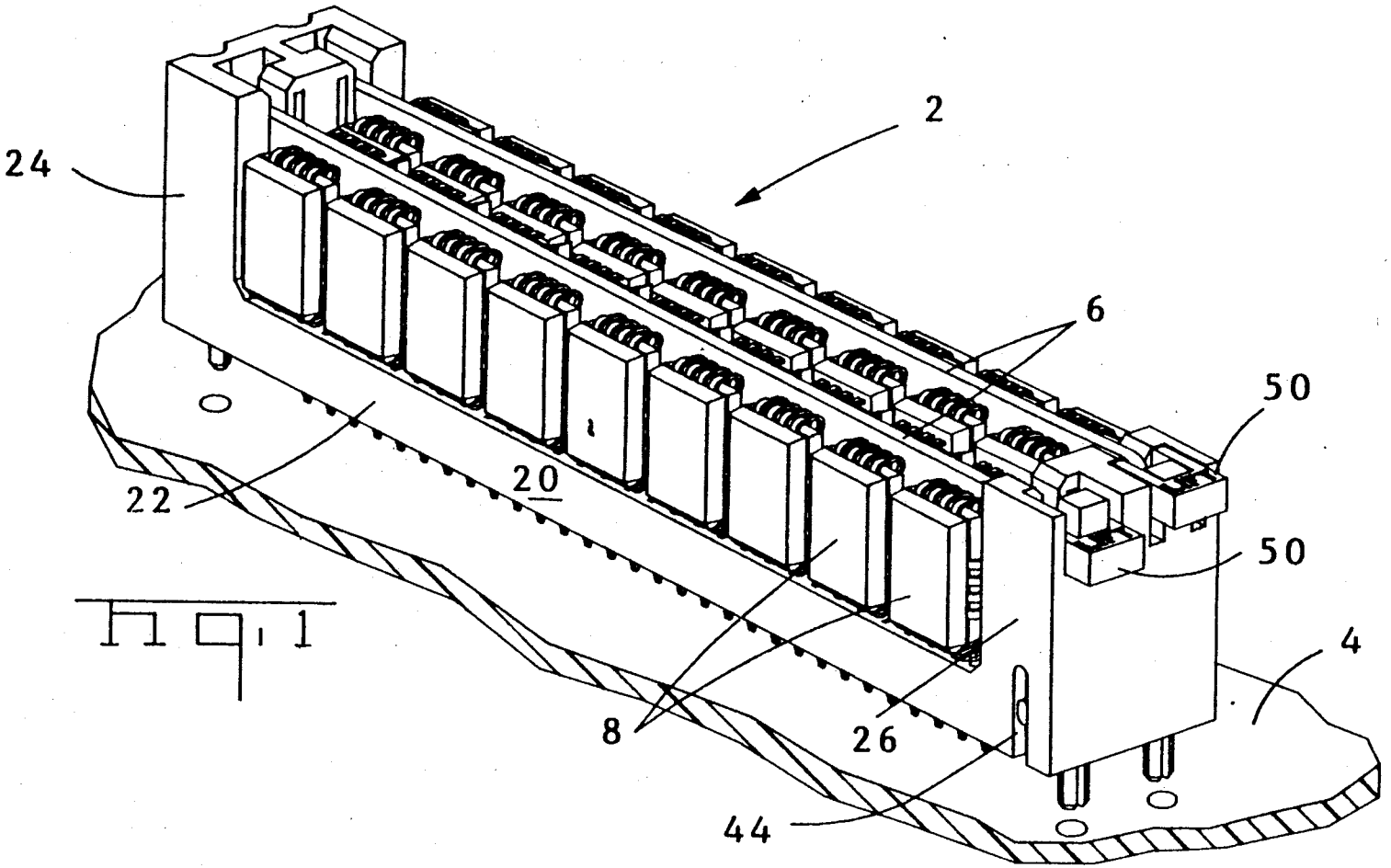
FIG. 1 is a perspective view of a socket suitable for receiving two circuit panels and suitable for mounting on a substrate.
Figure 2:
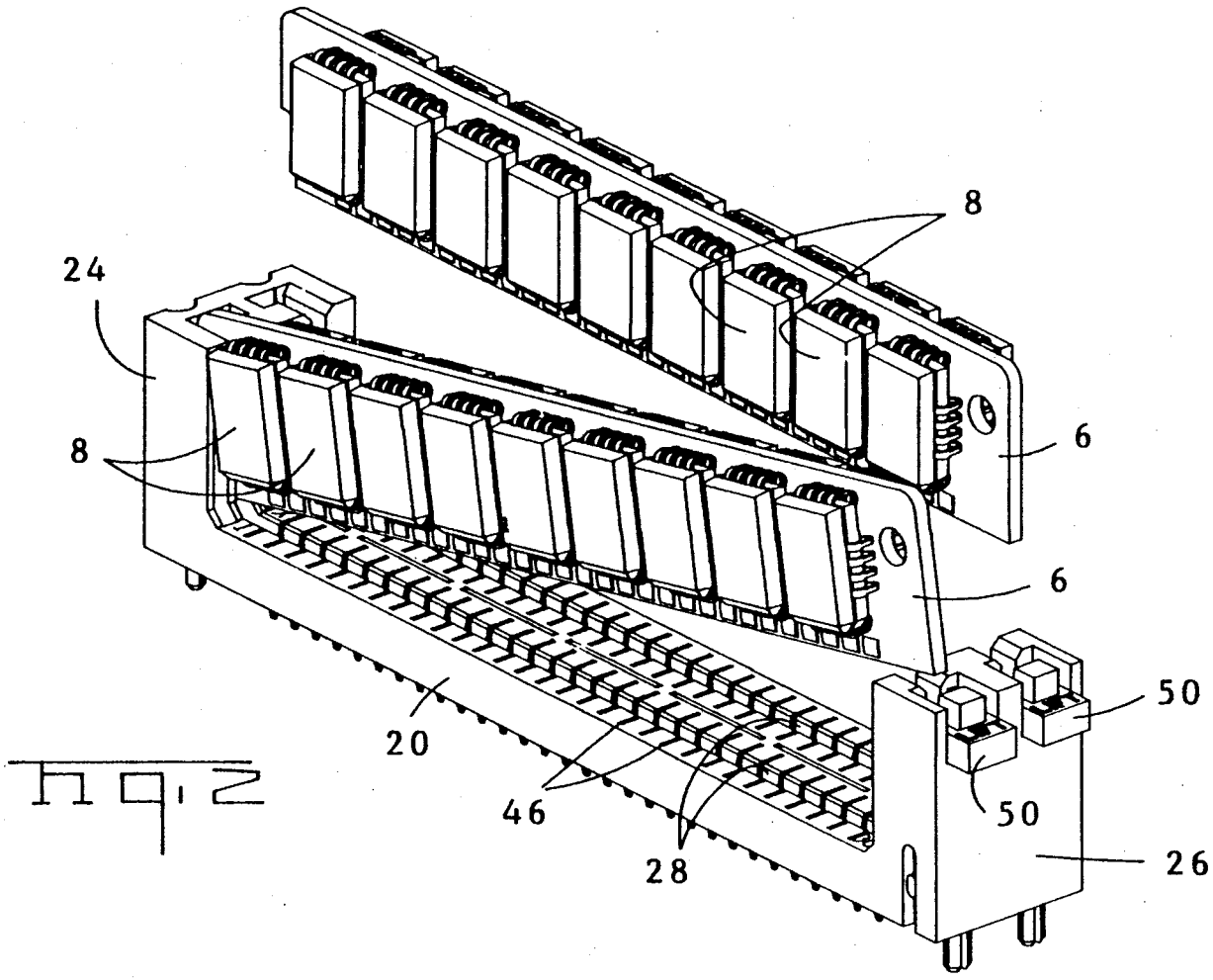
FIG. 2 is a perspective view similar to FIG. 1 showing two circuit panels, one of which is partially removed from the socket housing.
Figure 7:
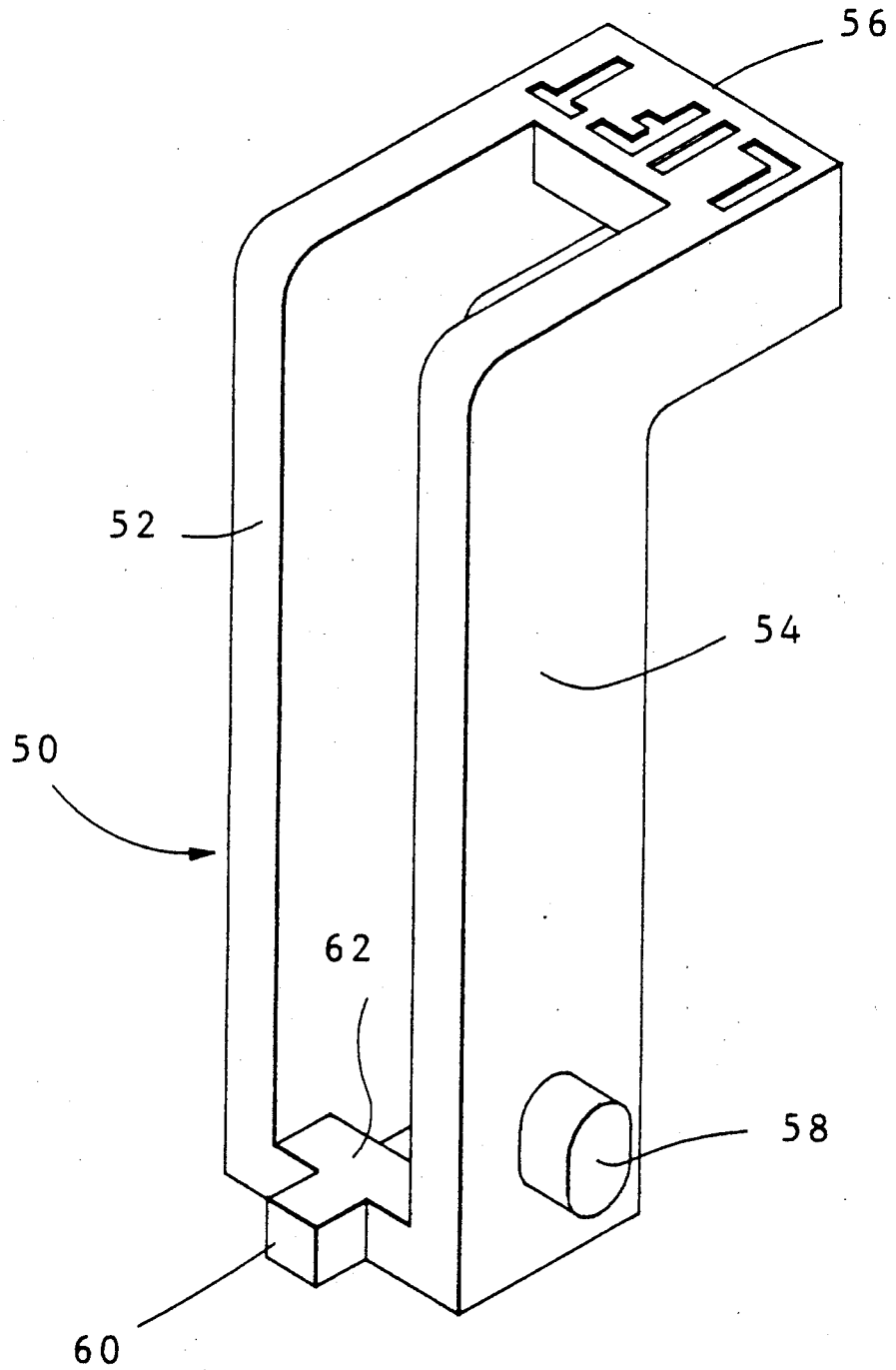

The electrical connector or socket 2 comprising the preferred embodiment of this invention can be mounted on a substrate 4 in a position to receive a circuit panel 6 so that the circuit panel 6 is positioned transversely relative to the substrate 4. This electrical connector or socket 2 is suitable for electrically interconnecting circuits on the substrate 4 to circuits on the circuit panel 6. A plurality of integrated circuit components 8 are located on the circuit panels 6 and terminals 10 contained within the electrical connector 2, are adapted to interconnect with traces on a circuit panel 6 leading to the integrated circuit components 8. In this manner the integrated circuit components 8 can be interconnected to traces on the substrate 4.

Each of the terminals 10 is edge stamped from a spring metal blank. Each terminal has a pair of opposed spring arms 12 and 14 which are outwardly deflectable upon insertion of a circuit panel between the two spring arms. A lead 16 extends downwardly from terminals 10 and the leads can be inserted in the holes in a substrate 4 to provide an interconnection between the terminals 10 and traces on the substrate 4. A upwardly extending barb 18 engages a central rib in the housing of the electrical connector to retain the terminals in the housing.

Figure 4:
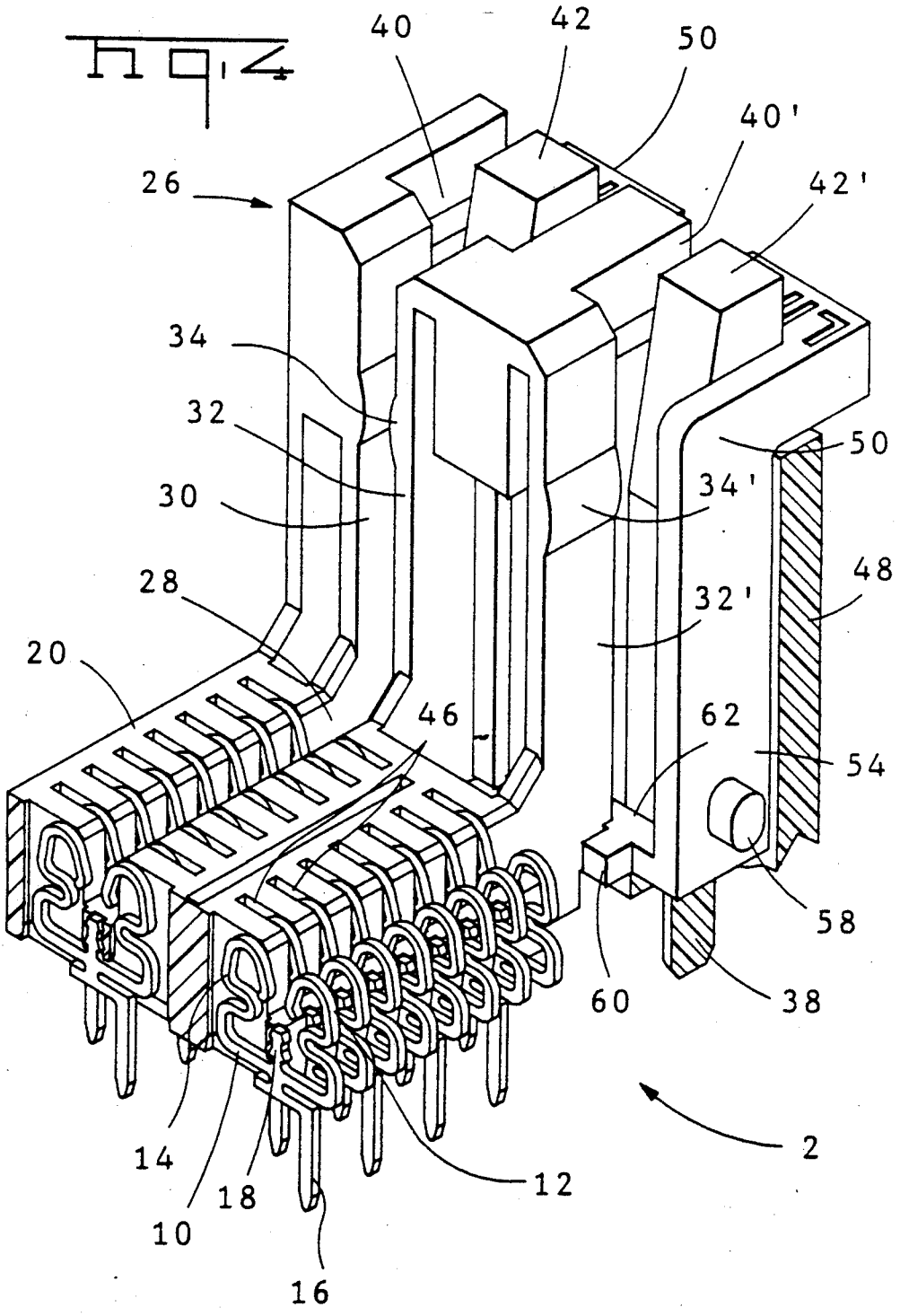
FIG. 4 is a perspective view partially in section showing the manner in which the extraction member is fitted within the insulative housing.

As can be seen in FIG. 4, the terminals 10 are positioned within the housing so that they can engage a circuit panel 6 inserted into the housing. The electrical connector 2 also includes an insulative housing 20 in which the plurality of terminals 10 are positioned. The housing 20 includes a central body 22 and two upright circuit panel support members 24 and 26 at either end thereof. The preferred embodiment of the invention depicted herein is suitable for interconnecting two circuit panels 4. Therefore, two upwardly open slots 28, into which circuit panels 6 can be inserted face upwardly along the central body 22. The terminals 10 are positioned adjacent the slot 28 and the terminals protrude into the slots so that when a circuit panel 6 is inserted into the slot, the terminals will engage traces on the circuit panel 6. The circuit panel support members 24 and 25 extend upwardly above the slot 28 at each end of slot 28. The circuit panel support members 24 and 26 are part of a one piece molded housing and these circuit panel support members 24 and 26 extend upwardly at either end of the central body 22.

Each of the circuit panel support members 24 and 26 includes means for holding the circuit panel in a position in which the terminals 10 can engage the circuit panel. This means for holding the circuit panels in the form of flexible walls 32, 32' each of which have gripping means 34, 34' for engaging the side of a circuit panel to hold the circuit panel in the housing. Each flexible wall 32, 32'is located on one side of a recess 30 located in the circuit panel supports 24 and 26 and communicating with the slot 28 so that a circuit panel 6 inserted into the slot 28 will also extend into the recess 30. Each flexible wall 30, 32' comprises a deflectable member for applying a force to the side of the circuit panel 6 when the circuit panel is positioned in engagement with the terminals 10. In the preferred embodiment of this invention, the flexible wall 32, 32' and the gripping means 34, 34' are located on one side of recess 30, but it should be understood that flexible walls could be located on opposite sides of recesses 30. The gripping means 34, 34' in the preferred embodiment of this invention comprises constricting ridges. When a circuit panel 6 is inserted into slot 28 and recess 30, engagement of the circuit panel with the ridges 34, 34' will impart deflection to the flexible walls 32, 32'. In the dual row socket comprising the preferred embodiment of this invention, flexible walls 32, 32' are part of a central support section 36.

Pockets 40, extending downwardly from the top of the upwardly extending circuit panel support members, are located on opposite sides of the center support section 36. These pockets 40 are generally in alignment with slot 28 and the flexible walls 32, 32' are located generally between the pockets 40 and the slots 28. Upright guide columns 42, 42' extend upwardly from the base of the housing in the pockets 40. The sides of the guide columns 42, 42' are spaced from the sides of the pockets 40, 40'. Guide columns 42, 42' are, however, integral with the end wall 48 of the housing 10. Grooves 44 communicating between the pockets 40, 40' and the exterior of the support members 24, 26 are located adjacent the lower end of support members 24, 26. These grooves 44 are straight and the upper end of each groove is enclosed.

The pockets 40 are configured for receipt of the extraction members 50. These circuit panel extraction members 50 are shiftable within the housing 20, relative to the flexible walls 32, 32' and the gripping ridges 34, 34' which comprise the means for holding the circuit panel 6 in the housing 20. The extraction member 50 is shiftable from a first position upwardly to a second position to release a circuit panel 6 from engagement with terminals 10 in the corresponding slot. These extraction members 50 are located within the pockets 40 in the circuit panel support member 26, and in the preferred embodiment of this invention two extraction members 50 are located within each a single circuit panel support 26 on one end of the slots 28. Each of the extraction members 50 is shiftable in translation, that is in a straight line, relative to the circuit panel support 24, 26, and each extraction member 50 is prevented from rotation relative to the circuit panel support 24, 26.

In the preferred embodiment of this invention, the extraction member 50 comprises two parallel arms 52, 54, each extending from a handle 56. These two parallel arms 52 and 54 extend downwardly from spaced apart locations on the handle 56, and in the preferred embodiment of this invention the two arms 52, 54 extend from opposite ends of the handle 56. Each of the arms 52, 54 is L-shaped so that the handle 56 at the upper end of the arms 52, 54 will protrude beyond the ends of the circuit panel support member 26 on the insulative housing 20. Thus, the handles 56 will be easily accessible to permit actuation of the extraction member 50 and movement thereof from the first to the second position so that a circuit panel 6 can be withdrawn from slot 28.

A crosspiece 62 extends between the two arms at the lower end of each arm 52, 54. A projection 60 extends inwardly, as seen in FIG. 6, from the crosspiece 62 relative to each of the arms 52, 54. The projection 60 is located below the gripping ridges 34, 34' which are used to hold the circuit panel within the slot 28 in engagement with terminals 10. The projection 60 also extends below a circuit panel 6, positioned within the slot 28 and protruding into the aligned recess 30. Each projection, extending laterally of the arms 52, 54 below the position of the circuit panel 6, held in engagement with terminals 10, extends inwardly for a sufficient distance to pivot one end of the circuit panel 6 upwardly out of the slot 28. The outwardly extending handle 56 extends in the opposite direction from the inwardly direct projection 60 and protrudes beyond the edge of the support member 26. Movement of the handle 56 upwardly will cause the projection to engage the lower edge of a corresponding circuit panel 6 to remove it from a slot 28 and disconnect the circuit panel form terminals 10. It is not necessary that the extraction member be used to completely remove the circuit panel from the housing, because once the extraction apparatus has pivoted the circuit panel, the circuit panel is readily accessible to the operator.

A protruding member 58 is located on the exterior of at least one arm in the extraction member 50. This protruding member 58 extends from the arm into an interfitting groove 44. Although the protruding member is moveable in the groove 44, the interfitting protruding member 58 and groove 44 cooperate to limit the freedom of movement of the extraction member 50 in at least one direction. In the preferred embodiment of this invention, the interfitting protruding member and the groove act to preclude rotation of the extraction member 50. The interfitting engagement of the protruding member 58 and the groove 44 also serves to prevent removal of the extraction member from the housing, because the protruding member 58 ultimately will engage the closed upper end of the groove 44.

The extraction members 50 are assembled to the insulative housing 20 by inserting each extraction apparatus 50 into the housing 20 from above. When the extraction members 50 are inserted into pockets 40, the protruding members 58 engage the sides of pockets 40 and the arms 52, 54 are sufficiently deformable so that upon engagement of the protruding member 58 with the sides of pocket 40, the arms 52, 54 flex inwardly until the protruding member 58 fits within groove 44. Once the protruding member 58 is position within the groove 44, the extraction member 50 is secured within the corresponding support member 26, but the extraction member 50 is moveable up and and down in the support member between a first and second position. Note that one of the extraction members 50 shown in FIG. 1 has been moved partially upward relative to the position of the other extraction member. This extraction member has been moved sufficiently upward to cause engagement of the projection 60 with the lower edge of the corresponding circuit panel 6 to pivot the circuit panel partly upwardly relative to the housing.

By locating one of these extraction member 50 in only one of the support members 26 at one end of the insulative housing a significant advantage can be achieved. Since the circuit panel 6 is pivoted upwardly out of engagement with the terminals 10 in slots 26 it is not necessary to remove the circuit panel out of engagement from all of the terminals along the entire length of the slot 28 at one time. Thus, the extraction force which needs to be applied to permit extraction of the circuit module is not excessive.

We claim:

1. An electrical connector of the type having a housing with a plurality of terminals disposed on opposite sides of a circuit panel receiving slot for electrically engaging traces on a circuit panel which may be inserted therein, said connector characterized in that the housing includes a circuit panel retaining means extending normally outwardly from the panel receiving slot and includes a pocket, said housing further includes a circuit panel extraction member positioned in said pocket and comprising an elongated arm, a projection at one end of said arm extending outwardly from one surface to underlie a circuit panel when in engagement with the terminals and a handle at an opposite end of said arm and extending outwardly from an opposite surface to provide an application of force to said extraction member to cause a linearly motion thereof whereby at least and end of the circuit panel overlying said projection moves out of engagement with the terminals.

2. The connector of claim 1, wherein said handle extends outwardly from said pocket and said retaining means.

3. The connector of claim 1 further including cooperating means on said housing and on said extraction member to prevent rotational motion thereof.

4. The connector of claim 3 wherein said cooperating means include a linear groove in said housing and a protruding member attached to said arm which is received in said groove to prevent rotational movement of said extraction member.

5. A socket mountable on a substrate for receiving a circuit panel, said socket comprising:

a housing having a plurality of terminals on opposite sides of an elongated circuit panel receiving slot and support members extending upwardly at one end of said slot, said support member having a pocket extending downwardly from a top thereof and a recess in communication with said slot and with said pocket; and an extraction member disposed in said pocket and reciprocally movable therein, said extraction member comprising an arm with a projection attached to one surface and at one end said projection extending into said slot through said recess to underlie a circuit panel which may be inserted into said slot so that upon lifting said extraction member at least a portion of the circuit panel moves out of said slot and a handle at another end extending outwardly from an opposite surface of said arm and outwardly of said pocket.

6. The socket of claim 5 wherein said support member and said extraction member includes cooperating means for limiting said extraction member to a linear motion.

* * * * *